US007717420B2

(12) United States Patent
Bechtler et al.

(10) Patent No.: US 7,717,420 B2
(45) Date of Patent: May 18, 2010

(54) APPARATUS FOR FEEDING SHEETS WITH VARIABLE OVERLAP LENGTH AND SHEET ARRIVAL CONTROL AND PRINTING PRESS HAVING THE APPARATUS

(75) Inventors: Jochen Bechtler, Malsch (DE); Oliver Nowarra, Leimen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 12 days.

(21) Appl. No.: 12/053,646

(22) Filed: Mar. 24, 2008

(65) Prior Publication Data

US 2008/0230977 A1 Sep. 25, 2008

(30) Foreign Application Priority Data

Mar. 23, 2007 (DE) ..... 10 2007 014 147

(51) Int. Cl.
*B65H 29/68* (2006.01)

(52) U.S. Cl. ..... 271/203; 271/202; 271/270

(58) Field of Classification Search ..... 271/270, 271/202, 203
See application file for complete search history.

(56) References Cited

U.S. PATENT DOCUMENTS 5,595,381 A * 1/1997 Schickedanz ..... 271/12
5,613,675 A * 3/1997 Kruger et al. ..... 271/270

FOREIGN PATENT DOCUMENTS

| | | | |
|---|---|---|---|
| DE | 44 44 755 | C2 | 8/1995 |
| DE | 195 09 468 | A1 | 9/1996 |
| DE | 195 09 548 | A1 | 9/1996 |
| DE | 197 55 518 | C2 | 6/1999 |
| DE | 100 21 211 | A1 | 10/2001 |
| EP | 1 201 577 | B1 | 5/2002 |
| EP | 1 528 021 | A1 | 5/2005 |

OTHER PUBLICATIONS

German Patent and Tradmark Office Search Report, dated Nov. 19, 2007.

* cited by examiner

*Primary Examiner*—Patrick H Mackey
*Assistant Examiner*—Gerald W McClain
(74) *Attorney, Agent, or Firm*—Laurence A. Greenberg; Werner H. Stemer; Ralph E. Locher

(57) ABSTRACT

An apparatus for feeding sheets in sheet-processing machines includes a transport belt which transports sheets from a first location to a second location. The transport belt can be driven at variable speed by a drive. The speed of the transport belt can be controlled by a control device in such a way that, through the use of a combination of at least two speed profiles, the number of sheets on the transport belt and the transfer of the sheets at the first and second locations can be adjusted. A printing press having the apparatus is also provided.

14 Claims, 2 Drawing Sheets

Figure 1:
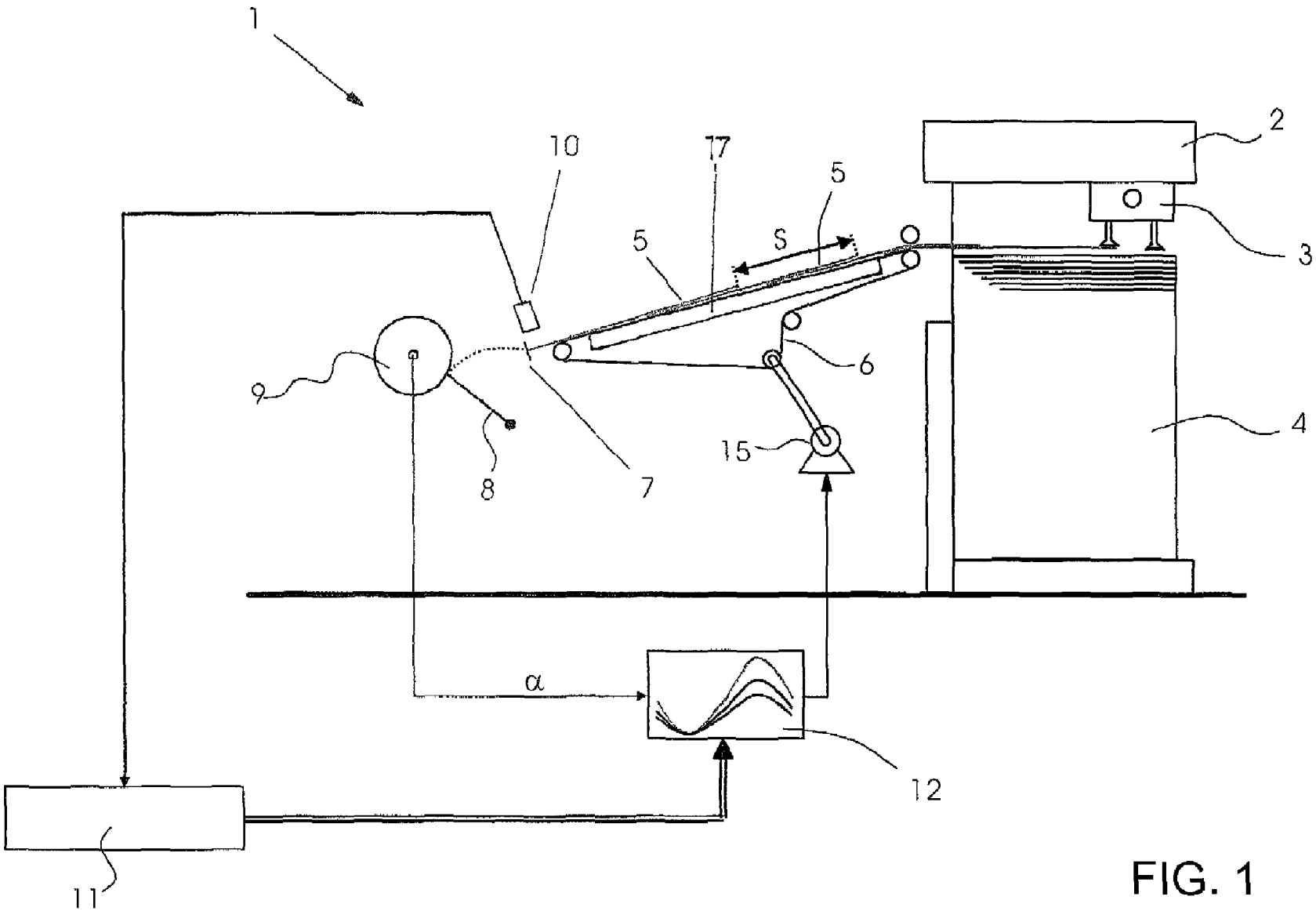

APPARATUS FOR FEEDING SHEETS WITH VARIABLE OVERLAP LENGTH AND SHEET ARRIVAL CONTROL AND PRINTING PRESS HAVING THE APPARATUS

CROSS-REFERENCE TO RELATED APPLICATION

This application claims the priority, under 35 U.S.C. §119, of German Patent Application DE 10 2007 014 147.7, filed Mar. 23, 2007; the prior application is herewith incorporated by reference in its entirety.

BACKGROUND OF THE INVENTION

Field of the Invention

The present invention relates to an apparatus for feeding sheets in sheet-processing machines, including a transport belt which transports sheets from a first location to a second location, and a drive for driving the transport belt at variable speed. The invention also relates to a printing press having the apparatus.

Such apparatuses are employed as feeders in printing presses or folding machines in order to feed sheets. In that case, the sheets are removed from a feed stack in order to be fed to a first printing unit or the folding machine. The feeder has the task of feeding the sheets to the printing press or the folding machine at a suitable cycle rate, so that they can be processed in a manner matched to the respective machine speed. Feeders normally have a transport belt for that purpose, which feeds the sheets, that are removed from the feed stack through the use of a suction apparatus, in overlapped form to the printing press or folding machine. An apparatus for conveying sheets in a feeder for a sheet-processing machine is disclosed by German Patent DE 44 44 755 C2, corresponding to U.S. Pat. No. 5,613,675. The feeder has an endless transport belt for that purpose, which transports the sheets from the feed stack as far as front stops of the sheet-processing machine. In that case, the transport belt is driven by an individual motor decoupled from the sheet-processing machine. The drive motor is actuated with a predefined speed profile through the use of a computing and control device, with speed changes being made as a function of an angular position of the sheet-processing machine. In that case, the sheet arrival is controlled through the selection of a speed profile. In the case of such a feeder control system, however, the number of overlapped sheet printing materials on the transport belt cannot be controlled as a function of the sheet arrival at the front lays or guides of the printing press.

A further sheet feeder is disclosed by European Patent EP 1 201 577 B1. That sheet feeder also has a belt table. The belt table does not have a dedicated drive but is coupled to the sheet-processing machine disposed downstream through the use of a step-change transmission. The number of sheets on the belt table can be adjusted variably through this step-change transmission. In an alternative embodiment, an individual electric motor can also be employed instead of the step-change transmission. The speed profiles of the suction belt and of a suction head are coordinated with each other in order to coordinate the sheet arrival and the transfer time between the suction head of the feeder and the transport belt. Therefore, the movement profile of the suction head is linked with the movement profile of the transport belt.

German Published, Non-Prosecuted Patent Application DE 195 09 468 A1 also discloses a sheet feeder unit in which a suction head and a transport belt are driven at the cycle rate of the sheet-processing machine. In addition, the transport speed of the transport belt can be increased during an operating cycle and then reduced again toward the end of the cycle. The extent of the speed increase or reduction can be adjusted variably. The reduction in the speed is used in such a way that, at the end of the cycle of the transfer to the sheet-processing machine, the sheet rests with its front edge on the front lays at a relatively low speed, so that a hard stop and therefore damage to front edges of the sheets is avoided. However, that feeder does not permit any variable setting of the number of sheet overlaps on the transport belt.

BRIEF SUMMARY OF THE INVENTION

It is accordingly an object of the invention to provide an apparatus for feeding sheets with variable overlap length and sheet arrival control in a sheet-processing machine and a printing press having the apparatus, which overcome the hereinafore-mentioned disadvantages of the heretofore-known devices of this general type and which, in a simple manner, permit both an adjustment of a number of overlaps on the transport belt and a sheet arrival control during sheet pick-up or sheet transfer.

With the foregoing and other objects in view there is provided, in accordance with the invention, an apparatus for feeding sheets in a sheet-processing machine. The apparatus comprises a transport belt transporting sheets from a first location to a second location. A drive drives the transport belt at a variable speed. A control device controls the speed of the transport belt to adjust a number of sheets on the transport belt and a transfer of the sheets at the first and second locations, by using a combination of at least two speed profiles.

The apparatus according to the invention is suitable for use in all feeders for sheet-processing machines, such as printing presses or folding machines. Such a feed apparatus has a transport belt which transports sheets from a first location to a second location, with the time and the speed during the sheet pick-up or sheet transfer at the first and second locations having to be matched to the sheet-processing machine. The transport belt, on which the sheets are transported in overlapped, shingled or imbricated form, has an individual drive, and it is possible for this drive to include either a variably actuated transmission coupled to the motor of the machine or an individual drive such as an electric motor.

In accordance with another feature of the invention, a sheet feeder has a suction head, and the first location is a sheet transfer from the suction head in the sheet feeder to the transport belt.

In accordance with a further feature of the invention, the transport belt is a suction belt, the sheet-processing machine is a printing press having a feed cylinder, and the second location is a transfer location from the suction belt to the feed cylinder of the printing press.

At the first location, the sheets coming from a paper stack in the feeder are lifted and separated through the use of a suction head. For the purpose of sheet transfer, there are also dragging suckers, which accelerate the sheets separated and lifted by the suction head and transfer them to the transport belt. The sheets can be fixed on the transport belt by suction nozzles, so that they do not slip. In this case, the transfer of the sheets at the first location takes place in a fixed angular window, with the dragging suckers and the transport belt moving synchronously during the sheet transfer. Since the sheets are likewise to be transferred to the sheet-processing machine at a defined speed at the second location, this sheet arrival must be controllable. In addition, according to the present invention, it is now also possible to change the number of overlaps on the transport belt merely through the use of the actuation of the speed of the transport belt. To this end, according to the invention, there are at least two speed profiles for actuating the transport belt over a machine cycle. If sheet pick-up and sheet transfer are carried out at the same machine angle or at the same time, then the number of overlaps on the transport belt is always an integer. The two speed profiles are put together in accordance with their task in an operating cycle so that, during sheet transfer and sheet pick-up, a speed profile for synchronous running is relevant, while in between, one or more speed profiles are used to control the number of overlaps and the sheet arrival. In between, in each case there is a transition point, at which the speed profiles merge into one another. At these transfer points, speed and acceleration of the transport profiles should ideally be the same in order to avoid jolts. For this purpose, the speed profiles are stored in an electronic control device of the sheet-processing machine or in a separate control computer, which controls the drive of the transport belt. In this way, in a printing press, the transfer of the sheets from the suction head to the transport belt in the feeder, the number of overlaps on the transport belt and the transfer from the suction belt to the feed cylinder of the printing press can be carried out merely by choosing at least two speed profiles and actuating the transport belt.

In accordance with an added feature of the invention, at least one of the speed profiles is sinusoidal. Since the speed during the sheet pick-up and sheet transfer is relatively low, while it is relatively fast during the sheet transport, speed fluctuations of the transport belt arise continually, depending on the machine cycle rate. These are best simulated without jolts through the use of sinusoidal speed profiles. In this case, it is possible to make use of sinusoidal speed profiles with different amplitude and frequency in one operating cycle. In particular, the section of the transport phase can also be composed of a plurality of sinusoidal components, with the necessary sinusoidal oscillations advantageously being calculated in a harmonic analysis, so that disruptive harmonics, which excite problematic oscillations, can be filtered out and not used.

In accordance with an additional feature of the invention, the sheet pick-up at the first location and the sheet transfer at the second location take place in a time-coupled manner at the same machine angle. In addition to the basically possible transfer or pick-up of the sheets at different machine angles, the simultaneous pick-up and transfer at the first and second locations results in an integer number of overlaps on the transport belt, with sheet pick-up and sheet transfer preferably taking place at a low machine speed. In this case, the suction head of the feeder rotates synchronously with the machine, which is to say it is coupled either mechanically or electrically to the machine speed. On the other hand, the transport belt is driven independently of the machine speed and of the drive of the suction head, so that the speed can be adjusted variably between sheet pick-up and sheet transfer.

In accordance with yet another feature of the invention, the number of sheets on the suction belt is determined exclusively by the control of the suction belt speed, through a variable characteristic map. This has the advantage that the speed of the suction head during the sheet transfer does not have to be changed. Instead, it is merely coupled to the machine speed, while the number of overlaps on the transport belt is achieved exclusively through the drive of the suction belt and the variable characteristic map in the control system of the suction belt drive. For this purpose, the suction belt is coupled to other drive motors of the printing press either by an individual electric drive or through an electronically controlled transmission, so that the speed of the transport suction belt can be controlled independently of the speed of the machine or of the feeder suction head.

In accordance with yet a further feature of the invention, a sheet transfer from a dragging sucker in the feeder of the printing press to the suction belt is carried out at the first location, while the dragging sucker and the suction belt are moving synchronously. This therefore ensures that, during the sheet transfer from the suction head to the transport belt, no slip occurs between the dragging sucker and the transport belt.

In accordance with yet an added feature of the invention, transitions of the at least two speed profiles have a continuous course. Therefore, jolt-like transitions between the individual speed profiles are avoided, in particular if both the first and the second derivative of the speed are continuous. Although it is also conceivable to make the transitions between the speed profiles in an acceleration-optimized manner or in a mixed form, that leads to jolts, which easily lead to the sheets slipping on the transport belt.

With the objects of the invention in view, there is concomitantly provided a printing press having the apparatus according to the invention.

Other features which are considered as characteristic for the invention are set forth in the appended claims.

Although the invention is illustrated and described herein as embodied in an apparatus for feeding sheets with variable overlap length and sheet arrival control and a printing press having the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTIONS OF THE SEVERAL VIEWS OF THE DRAWING

Figure 2:
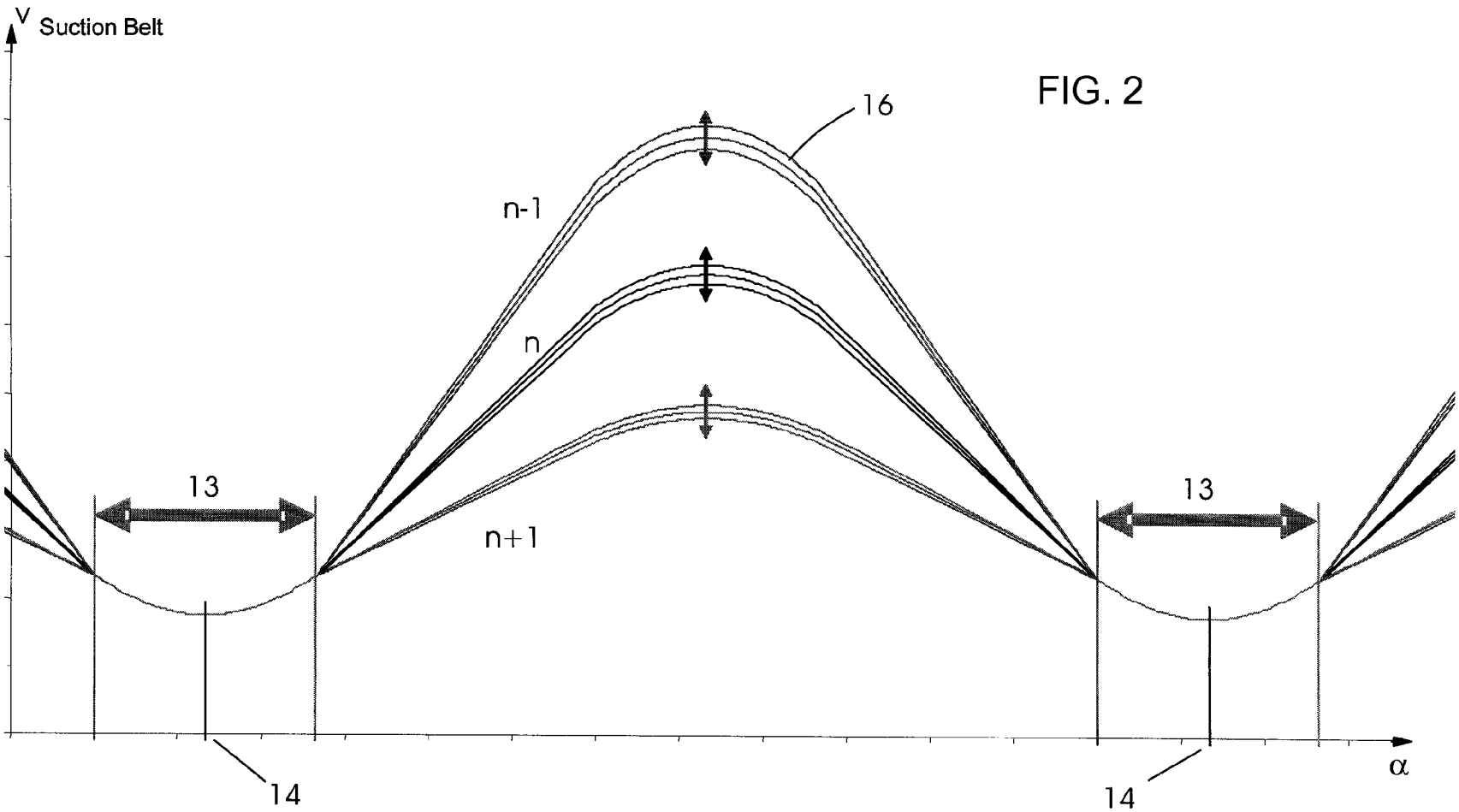

FIG. 1 is a diagrammatic and schematic view of a feeder for a sheetfed rotary printing press having a control device according to the invention; and FIG. 2 is a graph showing speed profiles according to the invention for actuating the sheet feeder in FIG. 1.

DETAILED DESCRIPTION OF THE INVENTION

Referring now to the figures of the drawings in detail and first, particularly, to FIG. 1 thereof, there is seen a printing press 1 having a feeder 2 in which an apparatus according to the invention for feeding sheets is implemented. The printing press 1 is illustrated herein only to the extent that a feed cylinder 9, which feeds sheets 5 to a first printing unit of the printing press 1 through the use of a pre-gripper 8, is depicted. The feeder 2 is used substantially to remove the sheets 5 from a feeder stack 4 and to transfer them to the feed cylinder 9 of the printing press 1. For this purpose, the sheets 5 are firstly lifted off the feeder stack 4, separated through the use of a suction head 3, and then transported in the direction of a transport suction belt 6 through the use of dragging suckers on the suction head 3. The sheets 5 are transported in overlapped, shingled or imbricated form on this suction belt 6 having a suction box 17, and it is possible for an overlap length s to be different, depending on a number n (see FIG. 2) of sheets 5 on the suction belt 6. The sheets are transported against a front guide or lay 7 at the end of the transport suction belt 6 at the lowest possible speed or at a standstill and, from there, are picked up from the feed cylinder 9 through the use of the pre-gripper 8. The sheets 5 are thus transported on the transport belt 6 from a first location at the suction head 3 to a second location at the front guide or lay 7. The feed cylinder 9 is coupled mechanically to the drive of the printing press 1, so that the rotational speed of the feed cylinder 9 is identical to the speed of the printing press 1. The speed or a machine angle $\alpha$ can be registered through the use of a rotary encoder on the feed cylinder 9 and used to control the feeder 2. The transport belt 6 in FIG. 1 is driven by an individual electric drive or drive motor 15, 50 that a speed $v_{suction\ belt}$ belt of the transport belt 6 can be controlled independently of the speed of the feed cylinder 9 and also of the suction head 3.

To this end, the electric drive motor 15 is monitored by a control computer 11, which is either integrated into the machine control system of the printing press 1 or is implemented as a separate computer and controls only the transport belt 6. Furthermore, sheet arrival control, which is provided in FIG. 1, is carried out through a sheet arrival sensor 10. The sheet arrival control is intended to ensure that the sheets 5 are always transferred at a time that is optimal for the feed cylinder 9. For this purpose, the arrival of the sheets 5 can be controlled through the speed $V_{suction\ belt}$ of the transport suction belt 6 during a transport phase 16 (see FIG. 2) as they are laid at the front guide or lay 7. The control of the speed $V_{suction\ belt}$ of the transport suction belt 6 is carried out in this case in the control computer 11 through the use of variable characteristic maps 12. The structure of these variable characteristic maps 12 can be gathered from FIG. 2.

It can be seen that the variable characteristic maps 12 in FIG. 2 are formed of two speed profiles. Firstly, there are speed profiles for a synchronous phase 13, which is to say a sheet arrival time 14. The variable characteristic maps 12 have a speed profile of the transport phase 16 between the speed profiles for the synchronous phase 13. The number n of sheets and the sheet arrival on the suction belt can be adjusted by using the speed profiles in the transport phase 16. It can be seen in FIG. 2 that large changes in the speed $V_{suction\ belt}$ of the suction belt 6 lead to a change in the number n of overlaps, while small changes in the region of about 1% can be used for the sheet arrival control. Therefore, in FIG. 2, slightly modified speed profiles for the sheet arrival control are also drawn in a narrow band around the respective speed profiles for one number n of overlaps. The lower the number n of sheets on the suction belt 6, the greater the speed difference between the maximum of the transport phase 16 and the minimum of the synchronous phase 13.

An operating cycle includes a synchronous phase 13 and a transport phase 16 in each case. In FIG. 2, the speed $V_{suction\ belt}$ of the suction belt 6 is plotted against the machine angle $\alpha$. In the embodiment according to FIG. 2, only the speed profiles of the transport phase 16 change, while the speed profiles of the synchronous phase 13 remain unchanged. The speed profiles 13 and 16 in FIG. 2 have a sinusoidal shape, which is to say they are formed of partial sine curves. Under certain circumstances, this leads to transitions between the speed profiles 13 and 16 running continuously only in one case. If a continuous transition is desired in all of the speed profiles, then different speed profiles in the synchronous phase 13 would also have to be used, although this is not uncritical. However, the use of other curves in the transport phase 16 is also possible. In particular, even further speed profiles can be used in order to keep the transitions between the sinusoidal synchronous phase 13 and the transport phase 16 continuous for all of the numbers of overlaps n on the transport suction belt 6. For example, in particular, curves from many sine oscillations can be assembled in superimposed form. These curves are produced by optimization through the use of harmonic analysis. In this way, merely by actuating the suction belt 6 with at least two speed profiles 13 and 16 in one operating cycle, both the sheet arrival 14 and the number n of overlaps on the transport belt 6 during the transport phase 16 can be controlled through the use of a single drive motor 15.

The invention claimed is:

1. An apparatus for feeding sheets in a sheet-processing machine, the apparatus comprising:

a transport belt transporting sheets from a first location to a second location defining an operating cycle;

a drive for driving said transport belt at a variable speed; and a control device for controlling the speed of said transport belt to adjust a number of sheets on said transport belt and a transfer of the sheets at said first and second locations, by using a combination of at least two speed profiles selected in accordance with respective tasks of said speed profiles within said operating cycle, at least one of said speed profiles is sinusoidal.

2. The apparatus according to claim 1, wherein said transport belt is a suction belt, the sheet-processing machine is a printing press having a feed cylinder, and said second location is a transfer location from said suction belt to said feed cylinder of the printing press.

3. The apparatus according to claim 1, wherein the sheet-processing machine is a printing press.

4. The apparatus according to claim 3, wherein said transport belt is a suction belt, and said suction belt is coupled to other drive motors of the printing press through an electronically controlled transmission.

5. The apparatus according to claim 3, wherein said transport belt is a suction belt, the printing press has a feeder with a dragging sucker, and a sheet transfer from said dragging sucker to said suction belt is carried out at said first location while said dragging sucker and said suction belt are moving synchronously.

6. The apparatus according to claim 1, wherein said at least two speed profiles include a speed profile in a transport phase being composed of a plurality of sinusoidal components.

7. The apparatus according to claim 1, wherein a sheet pick-up takes place at said first location, a sheet transfer takes place at said second location, and said sheet pick-up and said sheet transfer take place in a time-coupled manner at the same machine angle.

8. The apparatus according to claim 1, wherein said transport belt is a suction belt, and a variable characteristic map exclusively determines the number of sheets on said suction belt by controlling the speed of said suction belt.

9. The apparatus according to claim 1, wherein said transport belt is a suction belt, and said drive is an individual electric drive.

10. The apparatus according to claim 1, which further comprises a sheet feeder having a suction head, said first location being a sheet transfer from said suction head in said sheet feeder to said transport belt.

11. The apparatus according to claim 10, wherein the sheet-processing machine is a printing press, and said suction head in said sheet feeder operates synchronously with a speed of the printing press.

12. The apparatus according to claim 1, wherein the sheets are transferred at said second location only at a low speed or at a standstill.

13. The apparatus according to claim 1, wherein said at least two speed profiles have transitions with a continuous course.

14. A printing press, comprising an apparatus according to claim 1.

* * * * *